US008603962B2

(12) United States Patent
Bastigkeit et al.

(10) Patent No.: US 8,603,962 B2
(45) Date of Patent: Dec. 10, 2013

(54) METHODS FOR TREATING FABRIC IN A DRYER WITH A COMPOSITION COMPRISING SILICIC ACID ESTERS

(75) Inventors: Thorsten Bastigkeit, Wupperdal (DE); Jessica Lawshe, Chandler, AZ (US); Joan Bergstrom, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 889 days.

(21) Appl. No.: 12/597,782

(22) PCT Filed: Apr. 9, 2008

(86) PCT No.: PCT/US2008/059759

§ 371 (c)(1), (2), (4) Date: May 5, 2010

(87) PCT Pub. No.: WO2008/134212

PCT Pub. Date: Nov. 6, 2008

(65) Prior Publication Data

US 2010/0212181 A1 Aug. 26, 2010

Related U.S. Application Data

(60) Provisional application No. 60/914,566, filed on Apr. 27, 2007.

(51) Int. Cl.
*C11D 1/62* (2006.01)

(52) U.S. Cl.
USPC ..... 510/519; 510/520; 510/287; 510/295; 510/329; 510/330; 510/504; 510/515

(58) Field of Classification Search
USPC ..... 510/519, 520, 287, 295, 329, 330, 504, 510/515
See application file for complete search history.

(56) References Cited

U.S. PATENT DOCUMENTS

| | | | | |
|---|---|---|---|---|
| 2,547,944 | A | 4/1951 | Iler | |
| 3,215,719 | A | 11/1965 | Allen et al. | |
| 6,005,132 | A | 12/1999 | Weidner et al. | |
| 6,395,695 | B1 | 5/2002 | Sivik | |
| 7,098,178 | B2 | 8/2006 | Gerke et al. | |
| 2003/0158079 | A1 | 8/2003 | Dykstra et al. | |
| 2003/0162689 | A1 | 8/2003 | Schymitzek et al. | |
| 2003/0192197 | A1 * | 10/2003 | Griese et al. | 34/444 |
| 2004/0072704 | A1 * | 4/2004 | Gerke et al. | 510/101 |
| 2012/0021959 | A1 * | 1/2012 | Morgan et al. | 510/103 |

FOREIGN PATENT DOCUMENTS

| | | |
|---|---|---|
| GB | 2007703 | 5/1979 |
| GB | 2319527 | 5/1998 |
| WO | WO 01/68037 A | 9/2001 |
| WO | WO 2005/085404 A | 9/2005 |
| WO | WO 2005/120229 A | 12/2005 |

OTHER PUBLICATIONS

Bauer et al., "Common Fragrance and Flavor Materials", Wiley-VCH Publishers, Feb. 1997, 1-21.

* cited by examiner

*Primary Examiner* — Charles Boyer
(74) *Attorney, Agent, or Firm* — Woodcock Washburn LLP

(57) ABSTRACT

Methods of treating fabric in a dryer and the fabric treatment devices used to provide the fabric treatment composition to the fabric are disclosed. More particularly, methods of treating fabric in a dryer that provides treatment of fabric, including fragrance delivery onto the fabrics, during a multiple of treatment device uses, which may be useful in laundry drying applications and may also provide effective fragrance delivery to the laundered and dried fabrics are provided herein.

26 Claims, 1 Drawing Sheet

Fragrance Profile on the Fabric treatment device

METHODS FOR TREATING FABRIC IN A DRYER WITH A COMPOSITION COMPRISING SILICIC ACID ESTERS

CROSS-REFERENCE TO RELATED APPLICATIONS

This application is the National Stage of International Application No. PCT/US2008/059759, filed Apr. 9, 2008, which claims the benefit of U.S. Provisional Application No. 60/914,566, filed Apr. 27, 2007, the disclosures of which are incorporated herein by reference in their entirety.

FIELD OF THE INVENTION

The invention relates to methods of treating fabric in a dryer and the fabric treatment devices used to provide the fabric treatment composition to the fabric. More particularly, the present invention relates to methods of treating fabric in a dryer that provides treatment of fabric, including fragrance delivery onto the fabrics, during a multiple of treatment device uses, which may be useful in laundry drying applications and may also provide effective fragrance delivery to the laundered and dried fabrics.

BACKGROUND OF THE INVENTION

The controlled release of ingredients in various preparations is a subject of interest in a wide range of consumer applications. In the field of fabric treatment, controlled release is of great importance because the desire by consumers, and hence manufacturers, that the fabric articles are treated in a controlled fashion. In certain treatments, moreover, consumers desire a controlled and long-lasting subsequent release of the treatment composition, or parts thereof, that are imparted to the fabric during treatment. Such is the case, for example, with the perfuming of fabrics after clothing has been laundered. Consumers do not merely want clothing to smell fresh and clean immediately after laundering. Consumers want laundered fabric to be intensively and long-lastingly perfumed, thus providing an extended duration to the overall impression of clothing freshness and cleanliness during storage and/or while being worn, long after the laundering has been completed and the treatment has been imparted to their clothing articles.

A number of techniques have been employed to extend the duration of fragrance emanation from detergents, wash liquors, and laundered articles, including, for example, applying perfumes to carrier materials and coating the perfumed carriers, or encapsulating perfumes, or incorporating them in complexes (such as cyclodextrin/perfume complexes). Perfumes may also be chemically bound to carrier media, where the chemical bond may be slowly broken and the perfume concurrently released. This principle has been put into practice, for example, in the esterification of perfume alcohols.

One manner of chemical bond breaking that has been disclosed utilizes siloxanes as slow release vehicles for perfume alcohols. In the presence of small amounts of moisture, the perfume alcohols are slowly released by hydrolysis of the siloxane esters. For example, monomeric orthosilicic acid esters having one to four covalently bound perfume alcohols, for example, bis(eugenoxy)diethoxysilane or bis(cinnamoyloxy)diethoxysilane, are described, in U.S. Pat. No. 3,215,719.

Also disclosed in GB 2007703 is the use of silicon compounds containing perfume alcohols in laundry care, but this disclosure is limited to powder-form or granular detergents.

Oligosilicic acid esters containing perfume or biocide alcohols have been disclosed for use in detergents, including aqueous detergents (WO 01/68037, and related U.S. Pat. No. 7,098,178 B2), the disclosures of which are hereby incorporated herein by reference, in their entireties.

Acyclic siloxanes and related silicic acid esters incorporating perfume alcohols with the general formula $M_aM'_a.D_bD'_b.T_cT'_c.Qd$ where M and M'=$R_1R_2R_3SiO_{1/2}$, D and D'=$R_4R_5SiO_{2/2}$, T and T'=$R_6SiO_{3/2}$ and Q=$SiO_{4/2}$, where $R_1$ to $R_6$ independently of one another are selected from $C_{1-40}$alkyl or alkoxy and $C_{1-40}$aryl or aryloxy groups and the indices a, a' are positive and one or more of the indices b,b',c,c' and d are positive or 0, are described in GB 2319527. The use of those perfuming siloxanes in detergents was not mentioned in the application. Further, the disclosure underscored the problematic premature hydrolysis that occurred when water was allowed to come in contact with siloxanes or silicic acid esters.

Certain fabric conditioners directed to reduction in fluff formation and pilling in textiles, particularly during a washing or drying process and the use of those conditioners in a laundry drying process are disclosed in US2003/0162689 A1. The invention also discloses a conditioning substrate containing a conditioner and a conditioning process using the conditioning substrate in a laundry drying process.

Fabric surface treatment with certain benefit agent delivery systems that can, when directly applied to a substrate, provide a longer benefit term than when the benefit agent alone is applied to a fabric are disclosed in US2003/0158079. Benefit agents include perfumes, flavors, pharmaceuticals, and/or biocontrol agents (such as biocides, insecticides, and/or mildewcides).

Fragrance delivery systems for use in dryer-added fabric conditioning compositions which provides a long lasting scent to fabric through the use of linear acetal and/or ketal pro-fragrances to the fabric surface during laundering are disclosed in U.S. Pat. No. 6,395,695. wherein the pro-fragrances release their fragrance raw materials over a period of up to two weeks. The patent also discloses a method for delivering a pleasurable scent to fabric which has a lasting freshness quality by contacting the fabric with a laundry detergent composition which comprises the fragrance-releasable pro-fragrances.

Fragrance profiles of perfumed article vary with time, in part, because the individual perfume components emanate at different rates from the perfumed article based on their relative volatilities. More volatile components may dominate early odor impressions, while less volatile and/or more substantive components prevail with time. The ratios of components in the perfume remaining on and in the headspace above the article change over time, leading to changes in overall odor impression. Thus, certain aspects of the invention are directed to providing a more consistent fragrance impression over time.

Present single use dryer sheets provide incomplete transfer of treatment, such as fragrance onto cloth. A significant portion is lost to dryer exhaust air through the combined forces of heat, forced air, and humidity. Certain aspects of the invention are directed to efficient transfer of fragrance components, including certain more volatile components, onto fabric articles, leading to less overall component waste.

Further the use of reusable fabric treatment devices may assist in reducing the amount of landfill space consumed by disposal of the single use dryer sheets.

Accordingly, there is a need to provide fabric treatment, including for example, perfumes, fabric softeners, and/or biocides in a manner which not only treats the laundry care product, but which does so in a manner that creates persistent perfume on the laundered and dried article, allowing the article to retain its impression of freshness. There is also a need to provide more effective hydrophobic fragrance delivery vehicles, preferably comprising hydrolysis-resistant siloxane esters of perfume alcohols, which may be incorporated in reusable dryer devices for fabric treatment without showing excessive signs of hydrolysis in the fabric treatment composition itself.

Applicants have surprisingly found that certain combinations of cyclic and acyclic silicic acid esters provide effective levels of fabric treatment under conditions where elevated temperature and humidity conditions persist drying a clothes dryer cycle, including treatment which subsequently provides extended duration of perfume alcohol and/or biocide alcohol emanation. Applicants have further surprisingly found that certain fabric treatment devices containing fabric treatment compositions comprising certain cyclic and acyclic silicic acid esters may be employed multiple times in a dryer for treatment of fabric, without excessive hydrolysis of the esters due to temperature and/or humidity conditions present during the dryer cycles. The present invention is directed to these, as well as other important ends.

SUMMARY OF THE INVENTION

The invention is directed, in certain embodiments, to methods of treating fabric in a dryer comprising:

(a) contacting a first fabric with a reusable fabric treating device in a dryer, wherein the fabric treating device incorporates a fabric treatment composition comprising a silicic acid ester mixture of at least one silicic acid ester of formula I and at least one silicic acid ester of formula II:

I

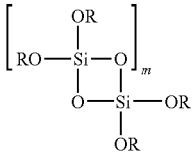

and

II

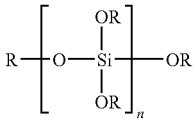

wherein:

each R is independently H, $C_1$-$C_6$alkyl, $C_2$-$C_6$alkenyl, perfume alcohol residual, or biocide alcohol residual;

m is an integer from 1 to about 20; and n is an integer from about 2 to about 100, provided that at least one R is a perfume alcohol residual or a biocide alcohol residual; and (b) transferring a portion of the fabric treatment composition from the dryer device to the fabric.

Other aspects of the invention relate to reusable fabric treating devices for transferring a portion of a fabric treatment composition from the fabric treating device to the fabric in a dryer, wherein the fabric treatment composition comprises a silicic acid ester mixture of at least one silicic acid ester of formula I and at least one silicic acid ester of formula II:

I

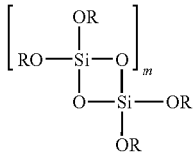

and

II

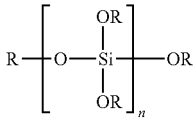

wherein:

each R is independently H, $C_1$-$C_6$alkyl, $C_2$-$C_6$alkenyl, perfume alcohol residual, or biocide alcohol residual;

m is an integer from 1 to about 20; and n is an integer from about 2 to about 100, provided that at least one R is a perfume alcohol residual or a biocide alcohol residual.

These and other embodiments of the invention will become more apparent from the following detailed description.

DETAILED DESCRIPTION OF ILLUSTRATIVE EMBODIMENTS

Figure 1:
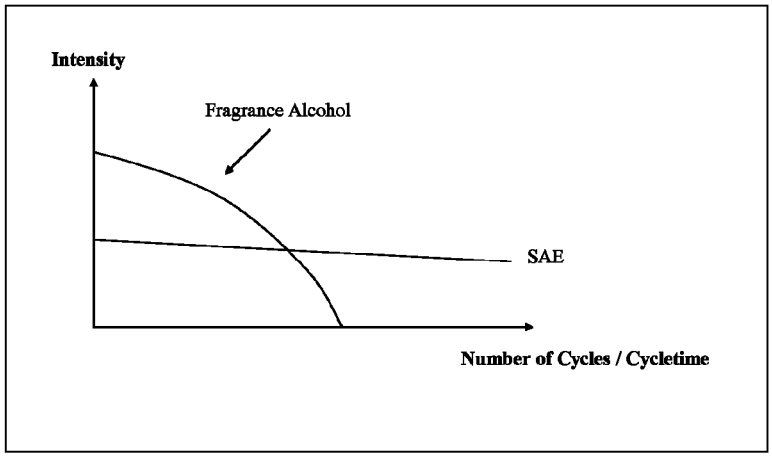
FIG. 1 shows the uniformity of geraniol profile over a number of dryer (or treatment) cycles emanating from a reusable fragrance treatment device when silicic acid esters are utilized in a fabric treatment composition as compared to the use of unbound geraniol in a similar composition.
Figure 2:
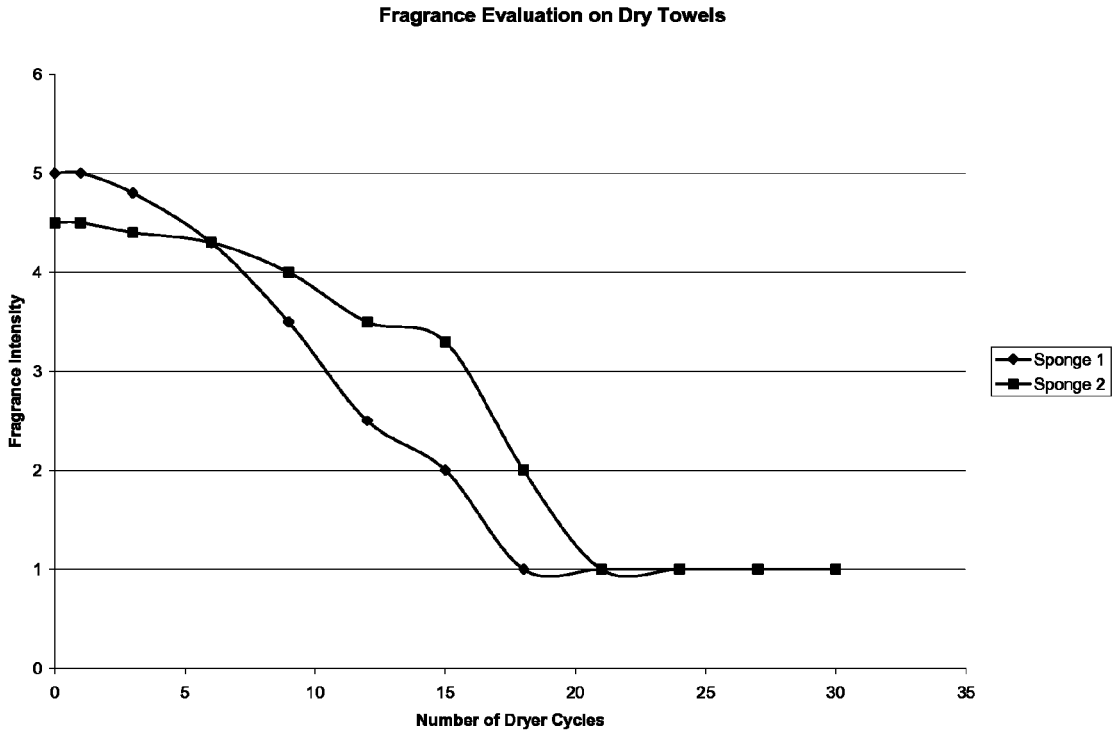
FIG. 2 illustrates the even profile of fragrance alcohol emanation from silicic acid ester treated fabric over a number of cycles compared with fragrance alcohol profile from unbound geraniol treated fabric post dryer treatment with a fabric treatment composition.

The present invention is generally methods of treating fabric in a dryer and the fabric treatment devices used to provide a fabric treatment composition to a fabric. More particularly, the present invention is directed to reusable fabric treatment devices and methods of treating fabric in a dryer employing the devices and fabric treatment compositions comprising silicic acid esters.

As employed above and throughout the disclosure, the following terms, unless otherwise indicated, shall be understood to have the following meanings.

As used herein, the term "alkyl" refers to an optionally substituted, saturated, straight or branched hydrocarbon having from about 1 to about 20 carbon atoms (and all combinations and subcombinations of ranges and specific numbers of carbon atoms therein), with from about 1 to about 6 carbon atoms being preferred. Alkyl groups include, but are not limited to, methyl, ethyl, n-propyl, isopropyl, n-butyl, isobutyl, sec-butyl, t-butyl, n-pentyl, isopentyl, neopentyl, n-hexyl, isohexyl, 3-methylpentyl, 2,2-dimethylbutyl, and 2,3-dimethylbutyl.

As used herein, the term "alkenyl" refers to an optionally substituted alkyl group having from about 2 to about 20, preferably about 2 to about 10, more preferably about 2 to about 6, carbon atoms, and one or more double bonds (and all combinations and subcombinations of ranges and specific numbers of carbon atoms therein), wherein alkyl is as previously defined.

As used herein, the term "perfume alcohol" refers to any compound or mixture of compounds of formula R'—OH, known to be a perfume, wherein R' is the residual of an aroma chemical or fragrance component (also known as residual of a perfume alcohol), that is capable of being physically or covalently bound to the hydrophobic delivery vehicle. irrespective of the further structure of the perfume compound. Non-limiting examples of perfume alcohols may be found in Steffan Arctander, "*Perfume and Flavor Chemicals* (*Aroma Chemicals*)", Volumes 1 and 2, (1969); Bauer, K. et al., "*Common Fragrance and Flavor Materials*", Wiley-VCH Publishers (1997); Guenther Ohloff, "*Scent and Fragrances*", Springer-Verlag Publishers (1994); and "*Perfumes: Art, Science, and Technology*", Mueller, P. M. l and Lamparsky, D, editors, Blackie Academic and Professional Publishers (1994), the disclosures of which are each hereby incorporated herein by reference, in their entireties.

In some embodiments, perfume alcohols include, for example, alcohols suitably released by the hydrolysis of the silicic acid esters of formula I, II, III, and/or IV or include those present as added fragrance to the fabric treatment compositions, including methanol, 2,4-dimethyl-3-cyclohexene-1-methanol (Floralol), 2,4-dimethyl cyclohexane methanol (Dihydro floralol), 5,6-dimethyl-1-methylethenylbicyclo[2.2.1]hept-5-ene-2-methanol (Arbozol), 2,4,6-trimethyl-3-cyclohexene-1-methanol (Isocyclo geraniol), 4-(1-methylethyl)cyclohexanemethanol (Mayol), a-3,3-trimethyl-2-norborane methanol, 1,1-dimethyl-1-(4-methylcyclohex-3-enyl)methanol, ethanol, 2-phenylethanol, 2-cyclohexylethanol, 2-(o-methylphenyl)-ethanol, 2-(m-methylphenyl)ethanol, 2-(p-methylphenyl)ethanol, 6,6-dimethylbicyclo-[3.1.1]hept-2-ene-2-ethanol (nopol), 2-(4-methylphenoxy)ethanol, 3,3-dimethyl-D.sup.2-b-norbornane ethanol, 2-methyl-2-cyclohexylethanol, 1-(4-isopropylcyclohexyl)-ethanol, 1-phenylethanol, 1,1-dimethyl-2-phenylethanol, 1,1-dimethyl-2-(4-methyl-phenyl)ethanol, n-propanol, 2-propanol, 1-phenylpropanol, 3-phenylpropanol, 2-phenylpropanol (Hydrotropic Alcohol), 2-(cyclododecyl)propan-1-ol (Hydroxy-ambran), 2,2-dimethyl-3-(3-methylphenyl)propan-1-ol (Majantol), 2-methyl-3-phenylpropanol, 3-phenyl-2-propen-1-ol (cinnamyl alcohol), 2-methyl-3-phenyl-2-propen-1-ol (methylcinnamyl alcohol), a-n-pentyl-3-phenyl-2-propen-1-ol (a-amyl-cinnamyl alcohol), ethyl-3-hydroxy-3-phenylpropionate, 2-(4-methylphenyl)-2-propenol, n-butanol, 2-butanol, 3-methylbutanol, 3-(4-methylcyclohex-3-ene)butanol, 2-methyl-4-(2,2,3-trimethyl-3-cyclopenten-1-yl)butanol, 2-ethyl-4-(2,2,3-trimethyl-cyclopent-3-enyl)-2-buten-1-ol, 3-methyl-2-buten-1-ol, 2-methyl-4-(2,2,3-trimethyl-3-cyclopenten-1-yl)-2-buten-1-ol, 3-hydroxy-2-butanone, ethyl 3-hydroxybutyrate, 4-phenyl-3-buten-2-ol, 2-methyl-4-phenylbutan-2-ol, 4-(4-hydroxyphenyl)butan-2-one, 4-(4-hydroxy-3-methoxyphenyl)butan-2-one, pentanol, cis-3-pentenol, 3-methyl-pentanol, 3-methyl-3-penten-1-ol, 2-methyl-4-phenylpentanol (Pamplefleur), 3-methyl-5-phenylpentanol (Phenoxanol), 2-methyl-5-phenylpentanol, 2-methyl-5-(2,3-dimethyltricyclo[2.2.1.0(2,6)]hept-3-yl)-2-penten-1-ol (santalol), 4-methyl-1-phenyl-2-pentanol, (1-methyl-bicyclo[2.1.1]hepten-2-yl)-2-methylpent-1-en-3-ol, 3-methyl-1-phenylpentan-3-ol, 1,2-dimethyl-3-(1-methylethenyl) cyclopentan-1-ol, 2-isopropyl-5-methyl-2-hexenol, cis-3-hexen-1-ol, trans-2-hexen-1-ol, 2-isoproenyl-4-methyl-4-hexen-1-ol (Lavandulol), 2-ethyl-2-prenyl-3-hexenol, 1-hydroxymethyl-4-iso-propenyl-1-cyclohexene (Dihydrocuminyl alcohol), 1-methyl-4-isopropenylcyclohex-6-en-2-ol (carvenol), 6-methyl-3-isopropenylcyclohexan-1-ol, 1-methyl-4-iso-propenylcyclohexan-3-ol, 4-isopropyl-1-methylcyclohexan-3-ol, 4-tert-butylcyclohexanol, 2-tert-butylcyclohexanol, 2-tert-butyl-4-methylcyclohexanol, 4-isopropylcyclohexanol, 4-methyl-1-(1-methylethyl)-3-cyclohexen-1-ol, 2-(5,6,6-trimethyl-2-norbornyl) cyclohexanol, isobornylcyclohexanol, 3,3,5-trimethylcyclohexanol, 1-methyl-4-isopropylcyclohexan-3-ol, 1,2-dimethyl-3-(1-methylethyl)cyclohexan-1-ol, heptanol, 2,4-dimethylheptan-1-ol, 2,4-dimethyl-2,6-heptandienol, 6,6-dimethyl-2-oxymethylbicyclo[3.1.1]hept-2-ene (myrtenol), 4-methyl-2,4-heptadien-1-ol, 3,4,5,6,6-pentamethyl-2-heptanol, 3,6-dimethyl-3-vinyl-5-hepten-2-ol, 6,6-dimethyl-3-hydroxy-2-methylenebicyclo[3.1.1] heptane, 1,7,7-trimethylbicyclo[2.2.1]heptan-2-ol, 2,6-dimethylheptan-2-ol, 2,6,6-trimethylbicyclo[1.3.3]heptan-2-ol, octanol, 2-octenol, 2-methyloctan-2-ol, 2-methyl-6-methylene-7-octen-2-ol (myrcenol), 7-methyloctan-1-ol, 3,7-dimethyl-6-octenol, 3,7-dimethyl-7-octenol, 3,7-dimethyl-6-octen-1-ol (citronellol), 3,7-dimethyl-2,6-octadien-1-ol (geraniol), 3,7-dimethyl-2,6-octadien-1-ol (nerol), 3,7-dimethyl-1,6-octadien-3-ol (linalool), 3,7-dimethyloctan-1-ol (pelagrol), 3,7-dimethyloctan-3-ol (tetrahydrolinalool), 2,4-octadien-1-ol, 3,7-dimethyl-6-octen-3-ol, 2,6-dimethyl-7-octen-2-ol, 2,6-dimethyl-5,7-octadien-2-ol, 4,7-dimethyl-4-vinyl-6-octen-3-ol, 3-methyloctan-3-ol, 2,6-dimethyloctan-2-ol, 2,6-dimethyloctan-3-ol, 3,6-dimethyloctan-3-ol, 2,6-dimethyl-7-octen-2-ol, 2,6-dimethyl-3,5-octadien-2-ol (muguol), 3-methyl-1-octen-3-ol, 7-hydroxy-3,7-dimethyloctanal, 3-nonanol, 2,6-nonadien-1-ol, cis-6-nonen-1-ol, 6,8-dimethylnonan-2-ol, 3-(hydroxymethyl)-2-nonanone, 2-nonen-1-ol, 2,4-nonadien-1-ol, 3,7-dimethyl-1,6-nonadien-3-ol, decanol, 9-decenol, 2-benzyl-M-dioxa-5-ol, 2-decen-1-ol, 2,4-decadien-1-ol, 4-methyl-3-decen-5-ol, 3,7,9-trimethyl-1,6-decadien-3-ol (isobutyl linalool), undecanol, 2-undecen-1-ol, 10-undecen-1-ol, 2-dodecen-1-ol, 2,4-dodecadien-1-ol, 2,7,11-trimethyl-2,6,10-dodecatrien-1-ol (farnesol), 3,7,11-trimethyl-1,6,10,-dodecatrien-3-ol, 3,7,11,15-tetramethylhexadec-2-en-1-ol (phytol), 3,7,11,15-tetramethylhexadec-1-en-3-ol (iso phytol), benzyl alcohol, p-methoxy benzyl alcohol (anisyl alcohol), para-cymen-7-ol (cuminyl alcohol), 4-methyl benzyl alcohol, 3,4-methylenedioxy benzyl alcohol, methyl salicylate, benzyl salicylate, cis-3-hexenyl salicylate, n-pentyl salicylate, 2-phenylethyl salicylate, n-hexyl salicylate, 2-methyl-5-isopropylphenol, 4-ethyl-2-methoxyphenol, 4-allyl-2-methoxyphenol (eugenol), 2-methoxy-4-(1-propenyl)phenol (isoeugenol), 4-allyl-2,6-dimethoxy-phenol, 4-tert-butylphenol, 2-ethoxy-4-methylphenol, 2-methyl-4-vinylphenol, 2-isopropyl-5-methylphenol (thymol), pentyl-ortho-hydroxy benzoate, ethyl 2-hydroxy-benzoate, methyl 2,4-dihydroxy-3,6-dimethylbenzoate, 3-hydroxy-5-methoxy-1-methylbenzene, 2-tert-butyl-4-methyl-1-hydroxybenzene, 1-ethoxy-2-hydroxy-4-propenylbenzene, 4-hydroxytoluene, 4-hydroxy-3-methoxybenzaldehyde, 2-ethoxy-4-hydroxybenzaldehyde, decahydro-2-naphthol, 2,5,5-trimethyl-octahydro-2-naphthol, 1,3,3-trimethyl-2-norbornanol (fenchol), 3a,4,5,6,7,7a-hexahydro-2,4-dimethyl-4,7-methano-1H-inden-5-ol, 3a,4,5,6,7,7a-hexahydro-3,4-dimethyl-4,7-methano-1H-inden-5-ol, 2-methyl-2-vinyl-5-(1-hydroxy-1-methylethyl) tetrahydrofuran, b-caryophyllene alcohol, 2-methylbutanol, 2-methylpentanol, 2-phenoxyethanol, 3,5,5-trimethylcyclohexanol, 3-hexanol, 3-octanol, 3-phenylpropanol, α-terpineol, amyl salicylate, benzyl salicylate, β-terpineol, butyl salicylate, citronellol, cyclohexyl salicylate, dimethyl benzyl carbinol, dimethyl heptanol, ethyl salicylate, ethyl vanillin, hexyl salicylate, isoborneol, isopulegol, menthol, n-hexanol, nonanol, octanol, p-methan-7-ol, phenol, phenyl salicylate, tetrahydrogeraniol, trans-2-cis-6-nonadienol, trans-2-nonen- 1-ol, trans-2-octenol, the various natural and synthetic sandalwood alcohols, cis-2-hexen-1-ol, and mixtures (and all combinations and subcombinations) thereof.

In certain preferred aspects of the invention, perfume alcohols include 10-undecen-1-ol, 2,6-dimethylheptan-2-ol, 2-methylbutanol, 2-methylpentanol, 2-phenoxyethanol, 2-phenylpropanol, 2-tert-butylcyclohexanol, 3,5,5-trimethylcyclohexanol, 3-hexanol, 3-methyl-5-phenylpentanol, 3-octanol, 3-phenylpropanol, 4-heptenol, 4-isopropyl cyclohexanol, 4-tert-butyl cyclohexanol, 6,8-dimethyl-2-nonanol, 6-nonen-1-ol, 9-decen-1-ol, α-methyl benzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-methan-7-ol, phenethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, tetrahydromyrcenol, the various natural and synthetic sandalwood alcohols, trans-2-hexen-1-ol, cis-2-hexen-1-ol, 1-octen-3-ol, and cinnamyl alcohol, and all combinations and subcombinations thereof.

In other preferred embodiments, alcohols suitably released by the hydrolysis of the silicic acid esters of formula I, II, III, and/or IV, and/or present as added fragrance to the fabric treatment compositions include 4-(1-methylethyl)cyclohexanemethanol (mayol), 2,4-dimethyl-3-cyclohexen-1-ylmethanol (floralol), 2,4-dimethylcyclohex-1-ylmethanol (dihydrofloralol), 2,4,6-trimethyl-3-cyclohexen-1-ylmethanol (isocyclogeraniol), 2-phenylethanol, 1-(4-isopropylcyclohexyl)ethanol (mugetanol), 2-(o-methylphenyl)ethanol (ortho-hawthanol), 2-(m-methylphenyl)ethanol (meta-hawthanol), 2-(p-methylphenyl)-ethanol (para-hawthanol), 2,2-dimethyl-3-(3-methylphenyl)propan-1-ol (majantol), 3-phenyl-2-propen-1-ol (cinnamic alcohol), 2-methyl-4-(2,2,3-trimethyl-3-cyclopenten-1-yl)-2-buten-1-ol (santalaire), 3-methyl-5-phenylpentan-1-ol (phenoxanol), 3-methyl-5-(2,2,3-trimethyl-3-cyclopenten-1-yl)-4-penten-2-ol (ebanol), 2-methyl-4-phenylpentan-1-ol (pamplefleur), cis-3-hexen-1-ol, 3,7-dimethyl-6-octen-1-ol (citronellol), 3,7-dimethyl-2,6-octadien-1-ol (geraniol, nerol or mixtures thereof), 7-methoxy-3,7-dimethyloctan-2-ol (osyrol), 3,7-dimethyl-1,6-octadien 3-ol (linalool), 2,6-dimethyl-7-octen-2-ol (dihydromyrcenol), 6,8-dimethylnonan-2-ol, cis-6-nonen-1-ol, 2,6-nonadien-1-ol, 4-methyl-3-decen-5-ol (undecavertol), benzyl alcohol, 2-methoxy-4-(1-propenyl)phenol (isoeugenol), 2-methoxy-4-(2-propenyl)phenol (eugenol), 4-hydroxy-3-methoxybenzaldehyde (vanillin), and mixtures thereof. More preferably 3,7-dimethyl-1,6-octadien-3-ol (linalool), 2,6-dimethyl-7-octen-2-ol (dihydromyrcenol), and mixtures thereof.

All isomers of a fragrance raw material whether in the form of the silicic acid ester or the released perfume alcohol, are suitable for use in the present invention. When optical isomers are possible, perfume alcohols may be present as a single enantiomer, diastereomer or any combination or subcombination of possible stereomers, including a racemic mixture. For example, 3,7-dimethyl-6-octen-1-ol, commonly known by those of ordinary skill in the art as β-citronellol or cephrol, comprises a pair of optical isomers, R-(+)-β-citronellol and S-(−)-β-citronellol. Each of these materials, separately or in any ratio of optical isomers is suitable for use as fragrance raw materials in the present invention. However, those skilled in the art of fragrances, by utilization of the present invention, should not disregard any olfactory differences that individual optical isomers impart.

When employed herein, the term "biocide alcohol" refers to any compound of formula R'—OH, wherein R' is the residual of an biocide compound, that is capable of being physically or covalently bound to the hydrophobic delivery vehicle. Biocide alcohols in the context of the present invention are understood to be any compounds which contain at least one alcohol group and which at least inhibits germ growth, such as for example, phenoxyethanol, 1,2-propylene glycol, glycerol, citric acid and esters thereof, lactic acid and esters thereof, salicylic acid and esters thereof, 2-benzyl-4-chlorophenol and 2,2'-methylene-bis-(6-bromo-4-chlorophenol). In certain preferable embodiments, non-limiting examples of biocide alcohols may include alcohols which also act as perfume alcohols. Perfume alcohols additionally having biocidal properties include, for example, citronellol, eugenol, farnesol, thymol, and geraniol. The lower alkyl alcohols described in the prior art as typical residues of the silicic acid esters do not count as biocide alcohols in the context of the present invention. Explicitly, methyl, ethyl, n-propyl, isopropyl, n-butyl, isobutyl and tert-butyl alcohol are not regarded as biocide alcohols in the context of the present invention. By contrast, conventional biocides with alcohol functions are expressly regarded as biocide alcohols in the context of the invention even though their effect is attributable to other functional groups. Various bromphenols and biphenylol and quaternary ammonium compounds containing at least one long alkyl chain and at least one alkyl group bearing a hydroxy group are mentioned by way of example in this regard.

As used herein, the term "first fabric" refers to one or more fabric articles such as clothing articles that come into contact with a fabric treatment device during an initial drying or treatment cycles of a clothes dryer.

When employed herein, the term "reusable fabric treatment device" refers to any fabric treatment device placed in a clothes dryer to provide treatment to one or more fabric articles that is capable of providing treatment to at least one fabric article in two or more drying or treatment cycles of a clothes dryer.

As used herein, the term "transferring a portion of the fabric treatment" from the reusable fabric treatment dryer device to a fabric refers to delivery of an amount less than the total amount of the remaining treatment on the device from the device to the fabric during dryer cycle contact. Preferably, the amount delivered to the fabric is less than about 95, more preferably less than about 75, still more preferably 50, yet more preferably less than about 25, even more preferably less than about 10 percent of the treatment contained in the fabric treatment device prior to its initial use in treating a first fabric. If the fabric treatment device is capable of being, and/or is recharged or reloaded with additional amounts of a fabric treatment composition, similar preferences apply for the delivered portions of the recharged device as with the virgin device.

Silicon derivatives of perfume alcohols have been prepared, among other ways, by transesterification of the lower alcohol silicon esters (WO 01/68037; GB 2007703, GB 2319527; U.S. Pat. No. 6,005,132; and U.S. Pat. No. 2,547,944), the disclosures of which are each hereby incorporated herein by reference, in their entireties. Transesterifications may be carried out, for example, as described in H. Steinmann, et al., Z. Chem. 3, 1977, pp. 89-92, the disclosure of which is hereby incorporated herein by reference, in its entirety. Commercially available silicic acid esters are normally used as educts. For example, the ethanol ester is obtainable from Wacker Chemie, Burghausen, Germany. The transesterification reaction may be controlled solely by increasing the temperature and distilling off the readily volatile byproduct lower alcohols. Often, however, catalysts are used for the transesterification. The catalysts typically include Lewis acids, preferably aluminum tetraisopropylate, titanium tetraisopropylate, or silicon tetrachloride, basic catalysts, or catalyst mixtures such as combinations of aluminum chloride with potassium fluoride. The oligomeric silicic acid esters thus formed incorporate at least one perfume alcohol, biocide alcohol, or any combination or subcombination of the two. If incompletely transesterified, the esters still contain residues of lower alcohols. Also, if small quantities of water or other H-acidic compounds are present during the production of the silicic acid esters, the perfume alcohol may be replaced by OH groups. Accordingly, the silicic acid ester mixtures according to the invention may also contain one or more hydrogens as $R^2$ substituents.

Oligosilicic acid esters of lower alcohols, such as methanol, ethanol, n-propanol, isopropanol, n-butanol, isobutanol, and tert-butanol, are commercially obtainable. The preparation of oligosilicic acid esters incompletely transesterified with perfume alcohols leads to silicic acid ester mixtures in which the substituents R are partly selected from the group consisting of methyl, ethyl, n-propyl, isopropyl, n-butyl, isobutyl and tert-butyl. Such compounds represent an embodiment of the present invention.

While not wishing to be bound by theory it is believed that one advantage of the silicic acid esters of the present invention is their relatively low volatility, which means that less treatment is lost to dryer exhaust gases during the drying cycle. This allows for more complete transfer of the silicic acid esters to the fabric, preferably in the presence of fabric softener on the fabric during fabric treatment, and presumably via direct or indirect physical contact between a fabric treatment device and one or more fabrics. Contrary to the known problems associated with hydrolysis of certain silicic acid esters in the presence of water and expected increases in rate of silicic acid ester hydrolysis with application of heat during the drying cycle, the compositions of the present invention may be transferred to successive cloths over a multiple of fabric treatment cycles.

Accordingly, the present invention is directed, in part, to methods of treating fabric in a dryer comprising:

(a) contacting a first fabric with a reusable fabric treating device in a dryer, wherein the fabric treating device incorporates a fabric treatment composition comprising a silicic acid ester mixture of at least one silicic acid ester of formula I and at least one silicic acid ester of formula II:

I

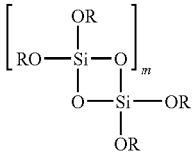

and

II

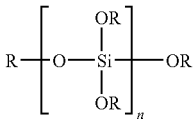

wherein:

each R is independently H, $C_1$-$C_6$alkyl, $C_2$-$C_6$alkenyl, perfume alcohol residual, or biocide alcohol residual;

m is an integer from 1 to about 20; and n is an integer from about 2 to about 100, provided that at least one R is a perfume alcohol residual or a biocide alcohol residual; and (b) transferring a portion of the fabric treatment composition from the dryer device to the fabric.

In some aspects of the methods of treating fabric in a dryer, the fabric treatment composition further comprises additional fragrance or perfume.

In other aspects of the methods of treating fabric in a dryer, the fabric treatment composition further comprises at least one of silicone oil, fabric conditioning composition, fabric softener (preferably wherein the fabric softener component comprises at least one of methyl bis(tallow amidoethyl)-2-hydroxyethyl ammonium methyl sulfate, methyl bis(oleylamidoethyl)-2-hydroxyethyl ammonium methyl sulfate, and methyl bis(hydrogenated tallow amidoethyl)-2-hydroxyethyl ammonium methyl sulfate, and mixtures thereof), fabric freshener, fabric anti-static agent, fabric anti-wrinkle agent, fabric speed-drying agent, dye transfer inhibition agent, color protection agent, odor removal or odor capturing agent, soil shielding or soil releasing agent, ultraviolet light protection agent, optical brightening agent, sanitizing agent, disinfecting agent, water repellency agent (preferably wherein the water repellency agent comprises at least one of perfluoroacrylate copolymer, hydrocarbon wax, and polysiloxane), insect repellency agent, anti-pilling agent (preferably wherein the anti-pilling agent comprises a cellulase enzyme), souring agent (preferably wherein the souring agent is a souring agent for neutralizing residual alkaline), mildew removing agent, anti-allergenic agent, water-salt-mixture, water-water soluble polymer mixture, and water-solvent mixture (preferably wherein the solvent of the solvent-water mixture comprises at least one of $C_1$-$C_6$alcohol, polyol, a polyethylene glycol, and a glycol ether), and mixtures thereof. In certain preferred embodiments, the fabric treatment composition further comprises a least one of thickening agent and surfactant, and mixtures thereof.

In some preferred embodiments, fabric treatment compositions comprise at least one cyclic silicic acid ester, acyclic silicic acid ester, or mixture thereof, more preferably a plurality of cyclic silicic acid esters, acyclic silicic acid esters, or mixtures thereof, with mixture or mixtures thereof being more preferred. In certain preferred embodiments, at least one cyclic silicic acid ester has the formula I:

I

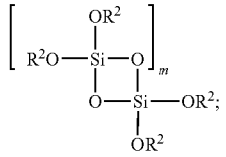

wherein each $R^2$ is independently is H, $C_{1-6}$alkyl, $C_{2-6}$alkenyl, $C_{2-6}$alkynyl, or the residual of perfume alcohol or biocide alcohol, preferably H, $C_{1-6}$alkyl, $C_{2-6}$alkenyl, or the residual of perfume alcohol or biocide alcohol, provided that at least one of $R^2$ is the residual of perfume alcohol or biocide alcohol; and m is an integer from 1 to 20, preferably 2 to 10.

In certain more preferred aspects of the invention, the at least one cyclic silicic acid ester of formula I has the formula:

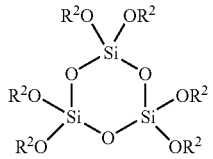

or

-continued

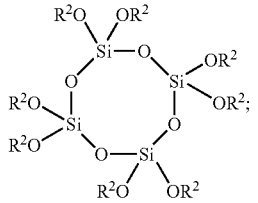

or mixture thereof.

In other preferred embodiments, at least one acyclic silicic acid ester has the formula II:

II

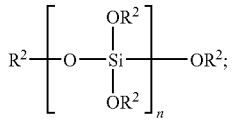

wherein each $R^2$ is independently is H, $C_{1-6}$alkyl, $C_{2-6}$alkenyl, $C_{2-6}$alkynyl, or the residual of perfume alcohol or biocide alcohol, preferably H, $C_{1-6}$alkyl, $C_{2-6}$alkenyl, or the residual of perfume alcohol or biocide alcohol, provided that at least one of $R^2$ is the residual of perfume alcohol or biocide alcohol; and n is an integer from 2 to 100, preferably 2 to 50, more preferably 2 to 20, still more preferably 2 to 10, with 4, 5, 6, 7, or 8 being even more preferred. In any of the embodiments hereinabove disclosed pertaining to cyclic or acyclic silicic acid esters, preferably at least about 75 percent, more preferably at least about 90 percent of the total $R^2$ substituents in the silicic acid esters, more preferably still, substantially all of the total $R^2$ substituents in the silicic acid esters are each independently the residual of perfume alcohol or biocide alcohol.

In certain embodiments, the methods of treating fabric in a dryer further comprise:

(c) separating the reusable dryer device from the treated fabric;

(d) contacting the separated reusable fabric treating device with a second fabric in a dryer; and (e) transferring a portion of the fabric treatment composition from the reusable fabric treating device to the second fabric.

In other embodiments of the methods of treating fabric in a dryer, at least one R in the fabric treatment silicic acid ester compounds of formula I, II, III, and/or IV is methyl, ethyl, n-propyl, isopropyl, n-butyl, isobutyl, or tert-butyl, preferably at least 5 mol % of the R substituents in the compounds of formula I, II, III, and/or IV are each independently methyl, ethyl, n-propyl, isopropyl, n-butyl, isobutyl, or tert-butyl.

In certain aspects of the methods of treating fabric in a dryer, at least 10 mol %, preferably at least 20 mol %, more preferably at least 40 mol % of the substituents R in the fabric treatment silicic acid ester compounds of formula I, II, III, and/or IV are each independently 10-undecen-1-ol, 2,6-dimethylheptan-2-ol, 2-methylbutanol, 2-methylpentanol, 2-phenoxyethanol, 2-phenylpropanol, 2-tert-butyl cyclohexanol, 3,5,5-trimethylcyclohexanol, 3-hexanol, 3-methyl-5-phenyl pentanol, 3-octanol, 3-phenylpropanol, 4-heptenol, 4-isopropyl cyclohexanol, 4-tert-butyl cyclohexanol, 6,8-dimethyl-2-nonanol, 6-nonen-1-ol, 9-decen-1-ol, α-methyl benzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-methan-7-ol, phenyl ethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, or cinnamyl alcohol.

Although the fabric treatment may comprise a silicic acid ester mixture of at least one silicic acid ester of formula I and at least one silicic acid ester of formula II as described herein, other ingredients may be added to supplement or enhance the overall fabric treatment desired.

Thus, in certain aspects of the invention, the fabric treatment composition comprises a cationic surfactant, such as at least one ester quat or at least one amidoamine quat, or any combination or subcombination thereof, and a perfume composition comprising a silicic acid ester mixture of at least one silicic acid ester of formula I and at least one silicic acid ester of formula II as described herein. A standard level for the cationic surfactant in the fabric treatment composition is from about 90 to about 99 weight percent based on the total weight of the fabric treatment composition. Typically the perfume composition level in the fabric treatment composition ranges from about 0.1 to about 10 weight percent, preferably 0.2 to about 2 weight percent based on the total weight of the fabric treatment composition. In other preferred embodiments, the fabric treatment composition further comprises one or more fragrance or biocide components, one or more fragrance materials, or any mixture thereof, that is/are not covalently bound to the silicic acid ester mixture.

In certain embodiments, the perfume composition generally comprises a mixture of at least one unbound perfume alcohol, and/or at least one unbound biocide alcohol, and/or other added fragrance materials and/or aroma chemicals, and/or a silicic acid ester mixture of at least one silicic acid ester of formula I and at least one silicic acid ester of formula II as described herein.

In general, the silicic acid ester is present at a level of from about 5 to about 100 weight percent of the total weight of the perfume composition, with about 20 to about 60 weight percent being preferred. These levels, as one of ordinary skill in the art would recognize, may be modified upward or downward accordingly, to account for the properties of the particular fragrance, biocide, mixture of fragrance and/or biocide, or fragrance component being delivered to the laundered article. Also as one of ordinary skill in the art recognizes, the actual ranges may vary depending on a large number of factors including the drying conditions to be employed, the fabric to be treated, the fabric treatment device used to deliver the treatment, and the like. The ranges herein described are intended to provide guidance to the skilled artisan, and are not intended to limit the scope of the invention.

The added fragrance may be present as synthetic or naturally occurring individual perfume compounds, their mixtures, including those containing ester, ether, aldehyde, ketone, or alcohol functional groups, as well as hydrocarbon-type molecules. Non-limiting examples of perfume compounds of the ester type include benzyl acetate, phenoxyethyl isobutyrate, p-tert-butyl cyclohexyl acetate, linalyl acetate, dimethyl benzyl carbinyl acetate(DMBCA), phenyl ethyl acetate, benzyl acetate, ethyl methyl phenyl glycinate, allyl cyclohexyl propionate, styrallyl propionate, benzyl salicylate, cyclohexyl salicylate, floramat, melusate and jasmacyclate. The ethers include, for example, benzyl ethyl ether and Ambroxan; the aldehydes include, for example, linear alkanals containing 8 to 18 carbon atoms, citral, citronellal, citronellyloxy acetaldehyde, cyclamen aldehyde, lilial and bourgeonal; the ketones include, for example, ionones, α-isomethyl ionone and methyl cedryl ketone; the alcohols include anethole, citronellol, eugenol, geraniol, linalool, phenyl ethyl alcohol and the various terpineols, while the hydrocarbons include, above all, terpenes, such as limonene and pinene. However, mixtures of perfume compounds which together produce an attractive perfume note are preferably used.

Fragrance mixtures may also contain natural perfume mixtures obtainable from vegetable sources, for example pine, citrus, jasmine, patchouli, rose, or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil, ladanum oil, orange blossom oil, neroli oil, orange peel oil, sandalwood oil, and others.

In addition to the impact that one or more functional groups, or a particular compound's overall structure may have on a perfume compound's odor impression, certain physical characteristics are also important to odor impression, such as volatility and intensity. For example, to be perceived by the receptors in the nose, perfume compounds require a certain minimum level of volatility. This volatility is controlled by, among other things, the molecular weight of the compound. Thus, most perfumes have molecular weights of up to about 200 dalton, molecular weights of 300 dalton and higher being less typical.

Intensity is usually expressed in terms of the minimum level of compound required at the odor receptor to trigger a recognition of the odorant. In view of the differences in volatility and intensity of perfumes, the odor of a perfume or fragrance composed of several perfume compounds changes during the evaporation process. Odor impressions are usually divided into the three aspects of top note, middle note (or body), and end note (or dry out). Relative to the overall perfume composition, the more volatile components are enriched in the initial phases (commonly referred to as "top note") of fragrance emanation from the product or laundered article. In the latter phases of fragrance emanation (commonly referred to as "end note or dry out"), the more volatile components fall to non-detectible limits, and the less volatile compounds predominate. In the composition of perfumes, more readily volatile perfumes may be fixed, for example, to certain "fixatives", which prevents them from volatilizing too rapidly. The hydrophobic fragrance delivery vehicles disclosed herein represent an effective method to fix certain fragrance compounds in the laundry care compositions of the present invention and extend their impression in the overall character of the perceived fragrance over time.

Firmly adhering perfumes suitable for use in accordance with the present invention are, for example, the essential oils, such as angelica root oil, aniseed oil, arnica flowers oil, basil oil, bay oil, champax blossom oil, silver fir oil, silver fir cone oil, elemi oil, eucalyptus oil, fennel oil, pine needle oil, galbanum oil, geranium oil, ginger grass oil, guaiac wood oil, Indian wood oil, helichrysum oil, ho oil, ginger oil, iris oil, cajeput oil, sweet flag oil, camomile oil, camphor oil, canaga oil, cardamom oil, cassia oil, Scotch fir oil, copaiba balsam oil, coriander oil, spearmint oil, caraway oil, cumin oil, lavender oil, lemon grass oil, limette oil, mandarin oil, melissa oil, amber seed oil, myrrh oil, clove oil, neroli oil, niaouli oil, olibanum oil, orange oil, origanum oil, palmarosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetiver oil, juniper berry oil, wormwood oil, wintergreen oil, ylang-ylang oil, ysop oil, cinnamon oil, cinnamon leaf oil, citronella oil, citrus oil and cypress oil. However, relatively high-boiling or solid perfumes of natural or synthetic origin may also be used in accordance with the invention as firmly adhering perfumes or perfume mixtures. These compounds include those mentioned in the following and mixtures thereof: ambrettolide, α-amyl cinnamaldehyde, anethole, anisaldehyde, anise alcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valerate, borneol, bornyl acetate, Boisambrene forte, α-bromostyrene, n-decyl aldehyde, n-dodecyl aldehyde, eugenol, eugenol methyl ether, eucalyptol, farnesol, fenchone, fenchyl acetate, geranyl acetate, geranyl formiate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl-n-amyl ketone, methyl anthranilic acid methyl ester, p-methyl acetophenone, methyl chavicol, para-methyl quinoline, methyl-β-naphthyl ketone, methyl-n-nonyl acetaldehyde, methyl-n-nonyl ketone, muskone, β-naphthol ethyl ether, β-naphthol methyl ether, nerol, n-nonyl aldehyde, nonyl alcohol, n-octyl aldehyde, p-oxyacetophenone, pentadecanolide, β-phenyl ethyl alcohol, phenyl acetaldehyde dimethyl acetal, phenyl acetic acid, pulegone, safrol, isoamyl salicylate, methyl salicylate, hexyl salicylate, cyclohexyl salicylate, santalol, sandelice, scatol, terpineol, thymene, thymol, troenan, γ-undecalactone, vanillin, veratrum aldehyde, cinnamaldehyde, cinnamyl alcohol, cinnamic acid, ethyl cinnamate, benzyl cinnamate.

The more readily volatile perfumes include, in particular, the relatively low-boiling perfumes of natural or synthetic origin which may be used either individually or in the form of mixtures. Examples of more readily volatile perfumes are diphenyl oxide, limonene, linalool, linalyl acetate and propionate, melusate, menthol, menthone, methyl-n-heptenone, pinene, phenyl acetaldehyde, terpinyl acetate, citral, citronellal.

The lower alcohol silicic acid esters used for the production of the fabric treatment silicic acid ester compositions present in some preferred aspects of the invention, may, for economic or other reasons, not be pure compounds, but instead may be technical mixtures of oligosilicic acid esters of lower alcohols with different degrees of oligomerization. The distribution of the degree of oligomerization may correspond directly to the degree of oligomerization present in the starting material or may be modified by the reaction conditions used to prepare the fragrance delivery vehicles. Thusly, a distribution of oligomerization, arising from use of starting materials or from use of certain reaction conditions, may be found in the fabric treatment silicic acid ester compositions, preferably the perfume alcohol containing silicic acid esters according to the invention that may be used in conjunction with fabric treatment components in the fabric treatment compositions of the present invention.

In some embodiments of the methods of treating fabric in a dryer, m is an integer from about 2 to about 10, preferably from about 2 to about 3 in the fabric treatment silicic acid ester compounds of formula I, II, III, and/or IV.

In other aspects of the methods of treating fabric in a dryer, n is an integer from about 2 to about 50, preferably from about 3 to about 10, with 4, 5, 6, 7, or 8 being even more preferred in the fabric treatment silicic acid ester compounds of formula I, II, III, and/or IV.

In certain embodiments of the methods of treating fabric in a dryer, the fabric treating device incorporates a fabric treatment composition comprising a silicic acid ester mixture of at least one silicic acid ester corresponding to the silicic acid ester of formula I and at least one silicic acid ester of formula II, wherein at least one silicic acid ester of formula I comprises a mixture of silicic acid esters corresponding to at least one silicic acid ester of formula III and at least one silicic acid ester of formula IV:

III

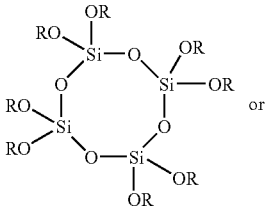

or

IV

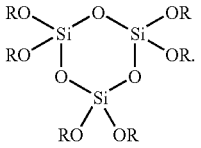

In certain embodiments of the methods of treating fabric in a dryer, the reusable dryer device comprises a porous body member, wherein the porous body member comprises:

(a) a porous body;

(b) a reservoir; and (c) a fabric treatment composition contained at least in part in the reservoir, the fabric treatment composition comprising an effective amount of the silicic acid ester mixture of formula I and formula II.

In certain preferred aspects, the porous body member further comprises:

(d) an end of use indicator coupled to the reservoir, wherein the substance induces a visual cue in the end of use indicator.

In other preferred aspects, the fabric treatment composition contained at least in part in the reservoir comprising an effective amount of a silicic acid ester mixture of formula I and formula II, wherein at least one silicic acid ester of formula I comprises a mixture of silicic acid esters corresponding to at least one silicic acid ester of formula III and at least one silicic acid ester formula IV:

III

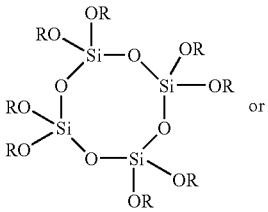

or

IV

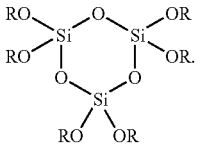

In other embodiments, the invention is directed to reusable fabric treating devices for transferring a portion of a fabric treatment composition from the fabric treating device to the fabric in a dryer, wherein the fabric treatment composition comprises an effective amount of a silicic acid ester mixture of at least one silicic acid ester of formula I and at least one silicic acid ester of formula II:

I

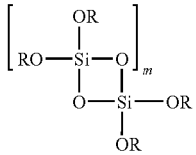

and

II

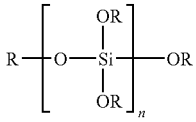

wherein:

each R is independently H, $C_1$-$C_6$alkyl, $C_2$-$C_6$alkenyl, perfume alcohol residual, or biocide alcohol residual;

m is an integer from 1 to about 20; and n is an integer from about 2 to about 100, provided that at least one R is a perfume alcohol residual or a biocide alcohol residual; preferably wherein at least one silicic acid ester of formula I comprises a mixture of silicic acid esters corresponding to at least one silicic acid ester of formula III and at least one silicic acid ester formula IV:

III

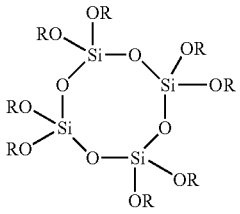

or

IV

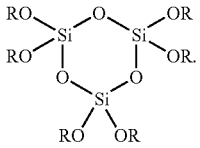

EXPERIMENTAL SECTION

Standard Towel Conditioning/Stripping Procedure:

This method was used to condition new towels and used towels. Specifically, this process was done to strip the towels in-between the dry and liquid fragrance consumer tests.

The washer settings were as follows:

Water Level="Large" (20 gallons)

Water Temperature="Hot/Cold" (Hot wash/cold rinse)

Rinse Option="Two Rinse" (if Two Rinse setting is not available, then hand set rinse dial for a second rinse cycle during the wash process)

Speed="Heavy Duty" or "Fast Cycle"

Wash Cycle="Standard" (12-14 minutes)

The washer cycle was started. As the washer filled with water, 1 capful of PUREX® "Free and Clear" detergent (The Dial Corporation) was added to the washer. The detergent was allowed to dissolve in the water. The towels were placed in the washer. After the second rinse and spin down, the wash cycle was repeated, but without detergent. When the final rinse was completed, the towels were removed from the washer and dried in a standard dryer. If the towels were not being used immediately, they were placed in sealed, plastic bags.

Standard Washing Procedure to Test Dryer Sheet Fragrance:

A. General Washer Procedure

This method was used to treat the towels for the dry towel consumer evaluation tests. All towels used in the testing procedures were conditioned using the "Standard Towel Conditioning/Stripping Procedure." This method assumes a hard water reading of 150 ppm. If multiple products are being tested in the same washer, an empty pre-wash cycle must be run between each test product load. It may be necessary to run an empty pre-wash cycle to remove any foreign material.

The washer was inspected to ascertain its cleanliness for the subsequent test. After the washer was confirmed as clean or cleaned as noted above, the washer cycle settings were set as follows:

Water Level="Large" (20 gallons)

Water Temperature="Warm/Cold" (Warm wash/cold rinse)

Rinse Option="One Rinse"

Speed="Heavy Duty" or "Fast Cycle"

Wash Cycle="Standard" (12-14 minutes)

The washer was started. As the washer filled with water, 3.1 fluid ounces of PUREX® "Free and Clear" detergent was added to the washer. The container holding the detergent was further rinsed with running water from the washer to completely transfer the detergent for the test. The tub was allowed to fill with water. Once filled, the agitator was turned on for 30 seconds to dissolve and distribute the detergent. The preconditioned towels were then added to the washer. The washer was restarted and allowed to complete the cycle.

B. General Dryer Procedure

For Dry Towel Evaluation:

The dryer was inspected for cleanliness. Cleaning, if necessary, was carried out by rubbing down the dryer drum with isopropyl alcohol. The drum was allowed to air dry for 15 minutes with the dryer door open. After the dryer was confirmed to be clean, the following setting were employed in the subsequent tests:

Temperature="Cotton" or "High Heat"

Timer="40 Minutes"

After completion of the final rinse cycle in the above-noted procedure, each towel was removed using gloved hands, and place into a clean dryer. A spongette or dryer sheet was placed on top of the bundle of wet towels and the dryer was started. After 40 minutes of drying, the towels are removed using gloved hands and folded in half in one direction, and then folded in half again in the other direction (see "Folding Procedure" below). The towels were placed in coded, plastic bags using gloved hands and sealed.

Folding Procedure:

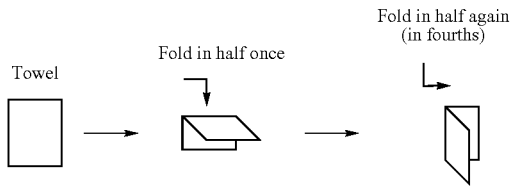

Treatment Test Comparison for Efficacy of Delivery of Silicic Acid Ester Versus Free Perfume Alcohol Using a Reusable Fabric Treatment Device Materials:

100 cotton washcloths

2 NEPTUNET™ HE Washing Machines (Maytag Corporation)

2 NEPTUNET™ HE Dryers

PUREX® Free & Clear detergent

Fabric Treatment Sponge 1—contains geraniol fragrance and softening ingredients

Fabric Treatment Sponge 2—silicic acid ester fragrance (equivalent level of geraniol) with softening ingredients Procedure:

Step 1: Two separate loads of 50 washcloths were washed using 3.1 fluid ounces of PUREX® Free & Clear employing the following cycle settings:

Fabrics—Cotton/Sturdy

Wash/Rinse=Hot/Cold

Options=Max Extra/Extra Rinse

Normal cycle w/3 rinses+1 extra rinse=approx. 40 min.

Step 2: The two loads of washcloths were subsequently washed without detergent to complete the conditioning/stripping procedure.

Step 3: The washcloths were dried in two separate dryers. One dryer contained sponge 1 and one set of washcloths (initially 50 in quantity). The second dryer contained sponge 2 and the second set of washcloths (initially 50 in quantity). The washcloths were dried under the following settings/conditions:

Temperature Selection=Regular

Options=Chime ON/OFF (optional)

Time Dry/Air Fluff for 60 min. cycle=approx. 60 min.

Step 4: Each set of washcloths was removed from its dryer, (each sponge remained in its respective dryer). Three washcloths from each set were placed in a sealed bag (1 set of cloths to each bag) for later fragrance evaluation. Steps 1 to 4 were repeated for the remaining washcloths in each set. A total of 30 wash/dry cycles were carried out.

Three (3) washcloths were removed from each set after cycles 1, 3, 6, 9, 12, 15, 18, 21, 24, 27, and 30 for fragrance evaluation.

Fragrance Evaluation of the Washcloths

| Cycle 1<br>Evaluation: |
|---|
| Day 1 - towels from both loads were very light in fragrance, with towels from sponge 1 being slightly stronger.<br>Day 5 - towels from both loads have no fragrance. Towels placed in plastic bags for future evaluation. |
| Cycle 3<br>Evaluation: |
| Day 2 - towels from both loads are very light in fragrance, with towels from sponge 1 being slightly stronger.<br>Day 5 - towels from both loads have no fragrance. Towels placed in plastic bags for future evaluation. |
| Cycle 6<br>Evaluation: |
| Day 7 - towels from both loads are light in fragrance, both smell equal in strength.<br>Day 9 - towels from both loads are light in fragrance, both smell equal in strength.<br>Towels placed in bags. |

-continued

| |
|---|
| Cycle 9<br>Evaluation: |
| Day 9 - towels from both loads are light in fragrance, towels from sponge 2 are slightly stronger.<br>Day 12 - towels from sponge 1 have no fragrance, smells like a clean towel.<br>Towels from sponge 2 still have fragrance. Towels placed in bags.<br>Cycle 12<br>Evaluation: |
| Day 13 - towels from load 2 are more fragrant than towels from load 1.<br>Day 16 - towels from load 2 are more fragrant, load 1 towels have no fragrance.<br>Cycle 15<br>Evaluation: |
| Day 16 - towels from load 2 are more fragrant than towels from load 1.<br>Day 19 - towels from load 2 are lightly fragrant, towels from load 1 have no fragrance.<br>Cycle 18<br>Evaluation: |
| Day 20 - towels from load 2 are lightly fragrant, towels from load 1 have no fragrance.<br>Day 22 - towels from 2 are lightly fragrant, 1 have no fragrance.<br>Cycle 21<br>Evaluation: |
| Day 22 - towels from 2 are very faint, towels from 1 loads have no fragrance.<br>Cycle 24<br>Evaluation: |
| Day 22 - towels from both loads have no fragrance.<br>Cycle 27<br>Evaluation: |
| Day 27 - towels from both loads have no fragrance.<br>Cycle 30<br>Evaluation: |
| Day 28 - towels from both loads have no fragrance. |

When ranges are used herein for physical properties, such as weight percent of compositions, all combinations and subcombinations of ranges and specific embodiments therein are intended to be included.

The disclosures of each patent, patent application and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed:

1. A method of treating fabric in a dryer comprising:

(a) contacting a first fabric with a reusable fabric treating device in a dryer, wherein the fabric treating device incorporates a fabric treatment composition comprising:

a silicic acid ester mixture of at least one silicic acid ester of formula I and at least one silicic acid ester of formula II:

I

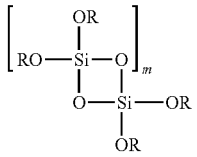

II

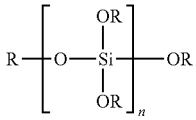

wherein:

each R is independently H, $C_1$-$C_6$alkyl, $C_2$-$C_6$alkenyl, perfume alcohol residual, or biocide alcohol residual;

m is an integer from 1 to about 20; and n is an integer from about 2 to about 100, provided that at least one R is a perfume alcohol residual or a biocide alcohol residual; and a fabric softener component comprising at least one softener selected from the group consisting of methyl bis(tallow amidoethyl)-2-hydroxyethyl ammonium methyl sulfate, methyl bis(oleylamidoethyl)-2-hydroxyethyl ammonium methyl sulfate, and methyl bis(hydrogenated tallow amidoethyl)-2-hydroxyethyl ammonium methyl sulfate, and mixtures thereof; and (b) transferring a portion of the fabric treatment composition from the dryer device to the fabric.

2. The method of claim 1, further comprising:

(c) separating the reusable dryer device from the treated fabric;

(d) contacting the separated reusable fabric treating device with a second fabric in a dryer; and (e) transferring a portion of the fabric treatment composition from the reusable fabric treating device to the second fabric.

3. The method of claim 1, wherein at least one R in the compounds of formula I and II is methyl, ethyl, n-propyl, isopropyl, n-butyl, isobutyl, or tert-butyl.

4. The method of claim 3, wherein at least 5 mol % of the R substituents in the compounds of formula I and II are each independently methyl, ethyl, n-propyl, isopropyl, n-butyl, isobutyl, or tert-butyl.

5. The method of claim 4, wherein at least 10 mol % of the substituents R in the compounds of formula I and II are each independently 10-undecen-1-ol, 2,6-dimethylheptan-2-ol, 2-methylbutanol, 2-methylpentanol, 2-phenoxyethanol, 2-phenylpropanol, 2-tert-butyl cyclohexanol, 3,5,5-trimethylcyclohexanol, 3-hexanol, 3-methyl-5-phenyl pentanol, 3-octanol, 3-phenylpropanol, 4-heptenol, 4-isopropyl cyclohexanol, 4-tert-butyl cyclohexanol, 6,8-dimethyl-2-nonanol, 6-nonen-1-ol, 9-decen-1-ol, α-methyl benzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-methan-7-ol, phenyl ethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, or cinnamyl alcohol.

6. The method of claim 5, wherein at least 20 mol % of the substituents R in the compounds of formula I and II are each independently 10-undecen-1-ol, 2,6-dimethylheptan-2-ol, 2-methylbutanol, 2-methylpentanol, 2-phenoxyethanol, 2-phenylpropanol, 2-tert-butyl cyclohexanol, 3,5,5-trimethylcyclohexanol, 3-hexanol, 3-methyl-5-phenyl pentanol, 3-octanol, 3-phenylpropanol, 4-heptenol, 4-isopropyl cyclohexanol, 4-tert-butyl cyclohexanol, 6,8-dimethyl-2-nonanol, 6-nonen-1-ol, 9-decen-1-ol, α-methyl benzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-methan-7-ol, phenyl ethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, or cinnamyl alcohol.

7. The method of claim 6, wherein at least 40 mol % of the substituents R in the compounds of formula I and II are each independently 10-undecen-1-ol, 2,6-dimethylheptan-2-ol, 2-methylbutanol, 2-methylpentanol, 2-phenoxyethanol, 2-phenylpropanol, 2-tert-butyl cyclohexanol, 3,5,5-trimethylcyclohexanol, 3-hexanol, 3-methyl-5-phenyl pentanol, 3-octanol, 3-phenylpropanol, 4-heptenol, 4-isopropyl cyclohexanol, 4-tert-butyl cyclohexanol, 6,8-dimethyl-2-nonanol, 6-nonen-1-ol, 9-decen-1-ol, α-methyl benzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-methan-7-ol, phenyl ethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, or cinnamyl alcohol.

8. The method of claim 1, wherein m is an integer from about 2 to about 10 and n is an integer from about 2 to about 50.

9. The method of claim 8, wherein m is an integer from about 2 to about 3 and is an integer from about 3 to about 10.

10. The method of claim 9, wherein n is the integer 4, 5, 6, 7, or 8.

11. The method of claim 1, wherein at least one silicic acid ester corresponding to the silicic acid ester of formula I comprises a mixture of silicic acid esters corresponding to at least one silicic acid ester of formula III and at least one silicic acid ester of formula IV:

III

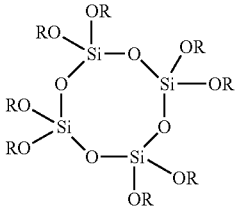

-continued

IV

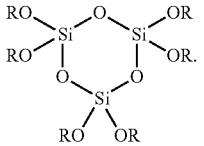

12. The method of claim 1, wherein the fabric treatment composition further comprises additional fragrance or perfume.

13. The method of claim 1, wherein the fabric treatment composition further comprises at least one of silicone oil, fabric conditioning composition, fabric freshener, fabric anti-static agent, fabric anti-wrinkle agent, fabric speed-drying agent, dye transfer inhibition agent, color protection agent, odor removal or odor capturing agent, soil shielding or soil releasing agent, ultraviolet light protection agent, optical brightening agent, sanitizing agent, disinfecting agent, water repellency agent, insect repellency agent, anti-pilling agent, souring agent, mildew removing agent, anti-allergenic agent, water-salt-mixture, water-water soluble polymer mixture, and water-solvent mixture, and mixtures thereof.

14. The method of claim 13, wherein the anti-pilling agent comprises a cellulase enzyme.

15. The method of claim 13, wherein the water repellency agent comprises at least one of perfluoroacrylate copolymer, hydrocarbon wax, and polysiloxane.

16. The method of claim 13, wherein the souring agent is a souring agent for neutralizing residual alkaline.

17. The method of claim 13, wherein the fabric treatment composition further comprises at least one of thickening agent and surfactant, and mixtures thereof.

18. The method of claim 13, wherein the solvent of the solvent-water mixture comprises at least one of $C_1$-$C_6$alcohol, polyol, a polyethylene glycol, and a glycol ether.

19. The method of claim 1, wherein the reusable dryer device comprises a porous body member, wherein the porous body member comprises:

(a) a porous body;

(b) a reservoir; and (c) a fabric treatment composition contained at least in part in the reservoir, the fabric treatment composition comprising an effective amount of the silicic acid ester mixture of formula I and formula II.

20. The method of claim 19, wherein the porous body member further comprises:

(d) an end of use indicator coupled to the reservoir, wherein the substance induces a visual cue in the end of use indicator.

21. The method of claim 19, wherein at least one silicic acid ester of formula I comprises a mixture of silicic acid esters corresponding to at least one silicic acid ester of formula III and at least one silicic acid ester formula IV:

III

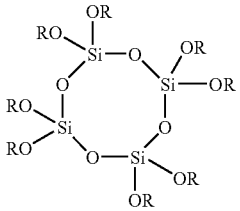

or

-continued

IV

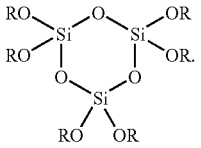

22. A reusable fabric treating device for transferring a portion of a fabric treatment composition from the fabric treating device to the fabric in a dryer, wherein the fabric treatment composition comprises an effective amount of a silicic acid ester mixture of at least one silicic acid ester of formula I and at least one silicic acid ester of formula II:

I

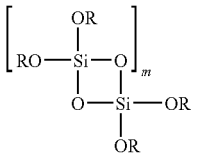

and

II

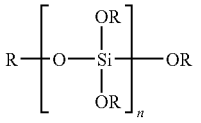

wherein:

each R is independently H, $C_1$-$C_6$alkyl, $C_2$-$C_6$alkenyl, perfume alcohol residual, or biocide alcohol residual;

m is an integer from 1 to about 20; and n is an integer from about 2 to about 100, provided that at least one R is a perfume alcohol residual or a biocide alcohol residual; and a fabric softener component comprising at least one softener selected from the group consisting of methyl bis(tallowamidoethyl)-2-hydroxyethyl ammonium methyl sulfate, methylbis(oleylamidoethyl)-2-hydroxyethyl ammonium methyl sulfate, and methyl bis(hydrogenated tallow amidoethyl)-2-hydroxyethylammonium methyl sulfate, and mixtures thereof.

23. The fabric treating device of claim 22, wherein at least one silicic acid ester of formula I comprises a mixture of silicic acid esters corresponding to at least one silicic acid ester of formula III and at least one silicic acid ester formula IV:

III

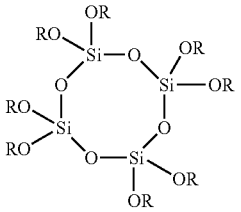

or

IV

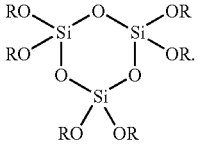

24. The method of claim 4, wherein at least 10 mol % of the substituents R in the compounds of formula I and II are each independently 2,4-dimethyl-3-cyclohexene-1-methanol (Floralol), 2,4-dimethyl cyclohexane methanol (Dihydro floralol), 5,6-dimethyl-1-methylethenylbicyclo[2.2.1]hept-5-ene-2-methanol (Arbozol), 2,4,6-trimethyl-3-cyclohexene-1-methanol (Isocyclo geraniol), 4-(1-methylethyl) cyclohexanemethanol (Mayol), α-3,3-trimethyl-2-norborane methanol, 1,1-dimethyl-1-(4-methylcyclohex-3-enyl)methanol, ethanol, 2-phenylethanol, 2-cyclohexylethanol, 2-(o-methylphenyl)-ethanol, 2-(m-methylphenyl)ethanol, 2-(p-methylphenyl)ethanol, 6,6-dimethylbicyclo-[3.1.1]hept-2-ene-2-ethanol (nopol), 2-(4-methylphenoxy)ethanol, 3,3-dimethyl-D.sup.2-b-norbornane ethanol, 2-methyl-2-cyclohexylethanol, 1-(4-isopropylcyclohexyl)-ethanol, 1-phenylethanol, 1,1-dimethyl-2-phenylethanol, 1,1-dimethyl-2-(4-methyl-phenyl)ethanol, n-propanol, 2-propanol, 1-phenylpropanol, 3-phenylpropanol, 2-phenylpropanol (Hydrotropic Alcohol), 2-(cyclododecyl)propan-1-ol (Hydroxy-ambran), 2,2-dimethyl-3-(3-methylphenyl)propan-1-ol (Majantol), 2-methyl-3-phenylpropanol, 3-phenyl-2-propen-1-ol (cinnamyl alcohol), 2-methyl-3-phenyl-2-propen-1-ol (methylcinnamyl alcohol), a-n-pentyl-3-phenyl-2-propen-1-ol (a-amyl-cinnamyl alcohol), ethyl-3-hydroxy-3-phenylpropionate, 2-(4-methylphenyl)-2-propenol, n-butanol, 2-butanol, 3-methylbutanol, 3-(4-methylcyclohex-3-ene)butanol, 2-methyl-4-(2,2,3-trimethyl-3-cyclopenten-1-yl)butanol, 2-ethyl-4-(2,2,3-trimethyl-cyclopent-3-enyl)-2-buten-1-ol, 3-methyl-2-buten-1-ol, 2-methyl-4-(2,2,3-trimethyl-3-cyclopenten-1-yl)-2-buten-1-ol, 3-hydroxy-2-butanone, ethyl 3-hydroxybutyrate, 4-phenyl-3-buten-2-ol, 2-methyl-4-phenylbutan-2-ol, 4-(4-hydroxyphenyl)butan-2-one, 4-(4-hydroxy-3-methoxyphenyl)butan-2-one, pentanol, cis-3-pentenol, 3-methyl-pentanol, 3-methyl-3-penten-1-ol, 2-methyl-4-phenylpentanol (Pamplefleur), 3-methyl-5-phenylpentanol (Phenoxanol), 2-methyl-5-phenylpentanol, 2-methyl-5-(2,3-dimethyltricyclo[2.2.1.0(2,6)]hept-3-yl)-2-penten-1-ol (santalol), 4-methyl-1-phenyl-2-pentanol, (1-methyl-bicyclo[2.1.1]hepten-2-yl)-2-methylpent-1-en-3-ol, 3-methyl-1-phenylpentan-3-ol, 1,2-dimethyl-3-(1-methylethenyl)cyclopentan-1-ol, 2-isopropyl-5-methyl-2-hexenol, cis-3-hexen-1-ol, trans-2-hexen-1-ol, 2-isoproenyl-4-methyl-4-hexen-1-ol (Lavandulol), 2-ethyl-2-prenyl-3-hexenol, 1-hydroxymethyl-4-iso-propenyl-1-cyclohexene (Dihydrocuminyl alcohol), 1-methyl-4-isopropenylcyclohex-6-en-2-ol (carvenol), 6-methyl-3-isopropenylcyclohexan-1-ol, 1-methyl-4-iso-propenylcyclohexan-3-ol, 4-isopropyl-1-methylcyclohexan-3-ol, 4-tert-butylcyclohexanol, 2-tert-butylcyclohexanol, 2-tert-butyl-4-methylcyclohexanol, 4-isopropylcyclohexanol, 4-methyl-1-(1-methylethyl)-3-cyclohexen-1-ol, 2-(5,6,6-trimethyl-2-norbornyl)cyclohexanol, isobornylcyclohexanol, 3,3,5-trimethylcyclohexanol, 1-methyl-4-isopropylcyclohexan-3-ol, 1,2-dimethyl-3-(1-methylethyl)cyclohexan-1-ol, heptanol, 2,4-dimethylheptan-1-ol, 2,4-dimethyl-2,6-heptandienol, 6,6-dimethyl-2-oxymethylbicyclo[3.1.1]hept-2-ene (myrtenol), 4-methyl-2,4-heptadien-1-ol, 3,4,5,6,6-pentamethyl-2-heptanol, 3,6-dimethyl-3-vinyl-5-hepten-2-ol, 6,6-dimethyl-3-hydroxy-2-methylenebicyclo[3.1.1]heptane, 1,7,7-trimethylbicyclo[2.2.1]heptan-2-ol, 2,6-dimethylheptan-2-ol, 2,6,6-trimethylbicyclo[1.3.3]heptan-2-ol, octanol, 2-octenol, 2-methyloctan-2-ol, 2-methyl-6-methylene-7-octen-2-ol (myrcenol), 7-methyloctan-1-ol, 3,7-dimethyl-6-octenol, 3,7-dimethyl-7-octenol, 3,7-dimethyl-6-octen-1-ol (citronellol), 3,7-dimethyl-2,6-octadien-1-ol (geraniol), 3,7-dimethyl-2,6-octadien-1-ol (nerol), 3,7-dimethyl-1,6-octadien-3-ol (linalool), 3,7-dimethyloctan-1-ol (pelagrol), 3,7-dimethyloctan-3-ol (tetrahydrolinalool), 2,4-octadien-1-ol, 3,7-dimethyl-6-octen-3-ol, 2,6-dimethyl-7-octen-2-ol, 2,6-dimethyl-5,7-octadien-2-ol, 4,7-dimethyl- 4-vinyl-6-octen-3-ol, 3-methyloctan-3-ol, 2,6-dimethyloctan-2-ol, 2,6-dimethyloctan-3-ol, 3,6-dimethyloctan-3-ol, 2,6-dimethyl-7-octen-2-ol, 2,6-dimethyl-3,5-octadien-2-ol (muguol), 3-methyl-1-octen-3-ol, 7-hydroxy-3,7-dimethyloctanal, 3-nonanol, 2,6-nonadien-1-ol, cis-6-nonen-1-ol, 6,8-dimethylnonan-2-ol, 3-(hydroxymethyl)-2-nonanone, 2-nonen-1-ol, 2,4-nonadien-1-ol, 3,7-dimethyl-1,6-nonadien-3-ol, decanol, 9-decenol, 2-benzyl-M-dioxa-5-ol, 2-decen-1-ol, 2,4-decadien-1-ol, 4-methyl-3-decen-5-ol, 3,7,9-trimethyl-1,6-decadien-3-ol (isobutyl linalool), undecanol, 2-undecen-1-ol, 10-undecen-1-ol, 2-dodecen-1-ol, 2,4-dodecadien-1-ol, 2,7,11-trimethyl-2,6,10-dodecatrien-1-ol (farnesol), 3,7,11-trimethyl-1,6,10,-dodecatrien-3-ol, 3,7,11,15-tetramethylhexadec-2-en-1-ol (phytol), 3,7,11,15-tetramethylhexadec-1-en-3-ol (iso phytol), benzyl alcohol, p-methoxy benzyl alcohol (anisyl alcohol), para-cymen-7-ol (cuminyl alcohol), 4-methyl benzyl alcohol, 3,4-methylenedioxy benzyl alcohol, methyl salicylate, benzyl salicylate, cis-3-hexenyl salicylate, n-pentyl salicylate, 2-phenylethyl salicylate, n-hexyl salicylate, 2-methyl-5-isopropylphenol, 4-ethyl-2-methoxyphenol, 4-allyl-2-methoxyphenol (eugenol), 2-methoxy-4-(1-propenyl)phenol (isoeugenol), 4-allyl-2,6-dimethoxy-phenol, 4-tert-butylphenol, 2-ethoxy-4-methylphenol, 2-methyl-4-vinylphenol, 2-isopropyl-5-methylphenol (thymol), pentyl-ortho-hydroxy benzoate, ethyl 2-hydroxy-benzoate, methyl 2,4-dihydroxy-3,6-dimethylbenzoate, 3-hydroxy-5-methoxy-1-methylbenzene, 2-tert-butyl-4-methyl-1-hydroxybenzene, 1-ethoxy-2-hydroxy-4-propenylbenzene, 4-hydroxytoluene, 4-hydroxy-3-methoxybenzaldehyde, 2-ethoxy-4-hydroxybenzaldehyde, decahydro-2-naphthol, 2,5,5-trimethyl-octahydro-2-naphthol, 1,3,3-trimethyl-2-norbornanol (fenchol), 3a,4,5,6,7,7a-hexahydro-2,4-dimethyl-4,7-methano-1H-inden-5-ol, 3a,4,5,6,7,7a-hexahydro-3,4-dimethyl-4,7-methano-1H-inden-5-ol, 2-methyl-2-vinyl-5-(1-hydroxy-1-methylethyl) tetrahydrofuran, b-caryophyllene alcohol, 2-methylbutanol, 2-methylpentanol, 2-phenoxyethanol, 3,5,5-trimethylcyclohexanol, 3-hexanol, 3-octanol, 3-phenylpropanol, α-terpineol, amyl salicylate, benzyl salicylate, β-terpineol, butyl salicylate, citronellol, cyclohexyl salicylate, dimethyl benzyl carbinol, dimethyl heptanol, ethyl salicylate, ethyl vanillin, hexyl salicylate, isoborneol, isopulegol, menthol, n-hexanol, nonanol, octanol, p-methan-7-ol, phenol, phenyl salicylate, tetrahydrogeraniol, trans-2-cis-6-nonadienol, trans-2-nonen-1-ol, trans-2-octenol, the various natural and synthetic sandalwood alcohols, or cis-2-hexen-1-ol.

25. The method of claim 4, wherein at least 10 mol % of the substituents R in the compounds of formula I and II are each independently 10-undecen-1-ol, 2,6-dimethylheptan-2-ol, 2-methylbutanol, 2-methylpentanol, 2-phenoxyethanol, 2-phenylpropanol, 2-tert-butylcyclohexanol, 3,5,5-trimethylcyclohexanol, 3-hexanol, 3-methyl-5-phenylpentanol, 3-octanol, 3-phenylpropanol, 4-heptenol, 4-isopropyl cyclohexanol, 4-tert-butyl cyclohexanol, 6,8-dimethyl-2-nonanol, 6-nonen-1-ol, 9-decen-1-ol, α-methyl benzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-methan-7-ol, phenethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, tetrahydromyrcenol, the various natural and synthetic sandalwood alcohols, trans-2-hexen-1-ol, cis-2-hexen-1-ol, 1-octen-3-ol, or cinnamyl alcohol.

26. The method of claim 4, wherein at least 10 mol % of the substituents R in the compounds of formula I and II are each independently 4-(1-methylethyl)cyclohexanemethanol (mayol), 2,4-dimethyl-3-cyclohexen-1-ylmethanol (floralol), 2,4-dimethylcyclohex-1-ylmethanol (dihydrofloralol), 2,4,6-trimethyl-3-cyclohexen-1-ylmethanol (isocyclogeraniol), 2-phenylethanol, 1-(4-isopropylcyclohexyl)ethanol (mugetanol), 2-(o-methylphenyl)ethanol (ortho-hawthanol), 2-(m-methylphenyl)ethanol (meta-hawthanol), 2-(p-methylphenyl)-ethanol (para-hawthanol), 2,2-dimethyl-3-(3-methylphenyl)propan-1-ol (majantol), 3-phenyl-2-propen-1-ol (cinnamic alcohol), 2-methyl-4-(2,2,3-trimethyl-3-cyclopenten-1-yl)-2-buten-1-ol (santalaire), 3-methyl-5-phenylpentan-1-ol (phenoxanol), 3-methyl-5-(2,2,3-trimethyl-3-cyclopenten-1-yl)-4-penten-2-ol (ebanol), 2-methyl-4-phenylpentan-1-ol (pamplefleur), cis-3-hexen-1-ol, 3,7-dimethyl-6-octen-1-ol (citronellol), 3,7-dimethyl-2,6-octadien-1-ol (geraniol, nerol or mixtures thereof), 7-methoxy-3,7-dimethyloctan-2-ol (osyrol), 3,7-dimethyl-1,6-octadien 3-ol (linalool), 2,6-dimethyl-7-octen-2-ol (dihydromyrcenol), 6,8-dimethylnonan-2-ol, cis-6-nonen-1-ol, 2,6-nonadien-1-ol, 4-methyl-3-decen-5-ol (undecavertol), benzyl alcohol, 2-methoxy-4-(1-propenyl)phenol (isoeugenol), 2-methoxy-4-(2-propenyl)phenol (eugenol), or 4-hydroxy-3-methoxybenzaldehyde (vanillin).

* * * * *

UNITED STATES PATENT AND TRADEMARK OFFICE

CERTIFICATE OF CORRECTION

PATENT NO. : 8,603,962 B2
APPLICATION NO. : 12/597782
DATED : December 10, 2013
INVENTOR(S) : Bastigkeit et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1080 days.

Signed and Sealed this
Twenty-second Day of September, 2015

Michelle K. Lee

Michelle K. Lee
*Director of the United States Patent and Trademark Office*